US010028577B2

(12) United States Patent
Attouche

(10) Patent No.: US 10,028,577 B2
(45) Date of Patent: Jul. 24, 2018

(54) ERGONOMIC WATCHMAKER'S WORKSTATION

(71) Applicant: ETA SA Manufacture Horlogere Suisse, Grenchen (CH)

(72) Inventor: Malik Attouche, Nyon (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 79 days.

(21) Appl. No.: 15/163,820

(22) Filed: May 25, 2016

(65) Prior Publication Data

US 2017/0013958 A1 Jan. 19, 2017

(30) Foreign Application Priority Data

Jul. 16, 2015 (EP) ..... 15177030

(51) Int. Cl.
*A47B 21/03* (2006.01)
*B25H 1/02* (2006.01)
(Continued)

(52) U.S. Cl.
CPC ..... *A47B 21/0371* (2013.01); *A47B 37/00* (2013.01); *A47B 83/001* (2013.01);
(Continued)

(58) Field of Classification Search
CPC ... A47B 21/0371; A47B 37/00; A47B 83/001; A47B 83/02; A47B 2021/0392; B25H 1/02; G04D 1/0014; G04D 1/0078
(Continued)

(56) References Cited

U.S. PATENT DOCUMENTS 5,004,196 A * 4/1991 Gross ..... A47B 21/0371 248/118.3
5,161,760 A * 11/1992 Terbrack ..... A47B 21/0371 248/118
(Continued)

FOREIGN PATENT DOCUMENTS

CH 248 542 5/1947
CH 394 989 7/1965
(Continued)

OTHER PUBLICATIONS

European Search report dated Feb. 29, 2016 in European Application 15177030, filed on Jul. 16, 2015 ( with English Translation and Written opinion).

*Primary Examiner* — Jose V Chen
(74) *Attorney, Agent, or Firm* — Oblon, McClelland, Maier & Neustadt, L.L.P.

(57) ABSTRACT

An ergonomic watchmaker's workstation includes, around a work platform, two forearm supports each at least tiltably adjustable in a vertical plane, and control and storage unit arranged to control motorized adjuster in order to move each of the forearm supports in at least one degree of freedom. The control and storage unit are programmable to trigger, at predefined or random moments, micro movements of the forearm supports of short duration, less than two seconds, and of small angular amplitude, less than 2° and/or of linear amplitude, less than 5 mm. The workstation further includes a user interface connected to the control and storage unit, to trigger other micro movements, and/or to modify the settings.

15 Claims, 7 Drawing Sheets

(51) Int. Cl.

| | |
|---|---|
| ***G04D 1/00*** | (2006.01) |
| ***A47B 37/00*** | (2006.01) |
| ***A47B 83/00*** | (2006.01) |
| ***A47B 83/02*** | (2006.01) |

(52) U.S. Cl.
CPC ..... *A47B 83/02* (2013.01); *B25H 1/02* (2013.01); *G04D 1/0014* (2013.01); *G04D 1/0078* (2013.01); *A47B 2021/0392* (2013.01)

(58) Field of Classification Search
USPC ..... 108/43, 50.01, 50.02; 248/918; 297/135, 297/174 R
See application file for complete search history.

(56) References Cited

U.S. PATENT DOCUMENTS 5,323,695 A * 6/1994 Borgman ..... A47B 9/00 108/147
5,605,311 A * 2/1997 McGrath ..... A47B 17/02 108/50.14
5,881,976 A * 3/1999 Gutowski ..... A47B 21/0371 248/118.1
5,988,076 A * 11/1999 Vander Park ..... A47B 21/06 108/50.02
6,248,014 B1 * 6/2001 Collier ..... A47B 21/00 454/186
6,296,408 B1 * 10/2001 Larkin ..... A47B 83/001 400/681
6,454,224 B1 * 9/2002 Nogueira ..... A47B 21/0371 248/118
7,620,667 B2 * 11/2009 Rollin ..... G06F 17/30174
7,823,973 B2 * 11/2010 Dragusin ..... A47C 7/72 108/50.01
7,905,460 B2 * 3/2011 Woods ..... F16M 11/10 248/220.21
8,678,936 B2 * 3/2014 Lesley ..... G07F 17/32 273/148 B
8,991,320 B2 3/2015 Desroches et al.
9,402,482 B2 * 8/2016 Miller ..... A47C 16/00
2008/0245279 A1 * 10/2008 Pan ..... A47B 9/00 108/144.11
2008/0282940 A1 * 11/2008 Marion ..... A47B 23/00 108/43
2010/0201165 A1 * 8/2010 Dankovich ..... A47B 83/001 297/135

FOREIGN PATENT DOCUMENTS

CH 512 971 9/1971
FR 1 400 357 5/1965

* cited by examiner

ERGONOMIC WATCHMAKER'S WORKSTATION

This application claims priority from European Patent Application No. 15177030.2 filed Jul. 16, 2015, the entire disclosure of which is hereby incorporated herein by reference.

FIELD OF THE INVENTION

The invention concerns an ergonomic watchmaker's workstation including, on either side of a work platform, two forearm supports each at least tiltably adjustable in a vertical plane, said workstation including control and storage means arranged to control motorised adjustment means in order to move each said forearm support in at least one degree of freedom.

The invention concerns the field of technical furniture for workers working in a seated position, and performing precision tasks at eye level.

BACKGROUND OF THE INVENTION

People performing manual watchmaking tasks often work with their hands at eye level, and occupy raised work stations, where their forearms are in a substantially horizontal position. Despite this particular arrangement, such people are often subject to musculoskeletal problems, particularly epicondylitis affecting the wrist, elbow or shoulder, and spinal problems, in addition to fatigue which is difficult to measure.

CH Patent 248542 in the name of MEYER & STUEDELI describes a workbench with forearm supports which, in a top view, form an obtuse angle with each other, and are each tilted in a vertical plane, and project from the workbench towards the user so that he does not have to lean forward.

FR Patent 1400357 in the name of SORMEL describes a workbench with symmetrical forearm support surfaces each tilted in a vertical plane, on either side of a horizontal platform forming a substantially trapezoid work surface, with which the forearm supports form a continuous smooth surface, covered with suitable coatings, on the one hand on the forearm surfaces, and on the other on the work surface. There are known improvements to this type of workbench with forearm supports that are each tiltably adjustable in a vertical plane by means of a connecting rod assembly.

CH Patent 394989 and CH Patent 512971 in the name of G.E. SCHLUP & Co. disclose this type of work stations with ball and socket point forearm supports.

US Patent 2014/020985 in the name of DesRoches discloses an automated workstation with some automated degrees of freedom, notably with a work surface that is height adjustable or completely movable on a circular rail.

However, these arrangements are insufficient for workers who are permanently required to work with their elbows resting on a support surface, and with their back resting against the back of a chair, and these benches do not include means for prevention of ankylosis and musculoskeletal problems.

SUMMARY OF THE INVENTION

The invention proposes to provide the watchmaker with an improved ergonomic workstation, which is more easily adaptable to the morphology of the user and to the tasks to be performed than known prior art systems, and which ensures the prevention of musculoskeletal problems.

In addition to the possibility of adjustment in several degrees of freedom, the invention includes motorised, storable and customizable settings, and the motor means used for the settings allow programmable micro movements to be made, intended to prevent ankylosis in the user.

To this end, the invention concerns an ergonomic watchmaker's workstation according to claim 1.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
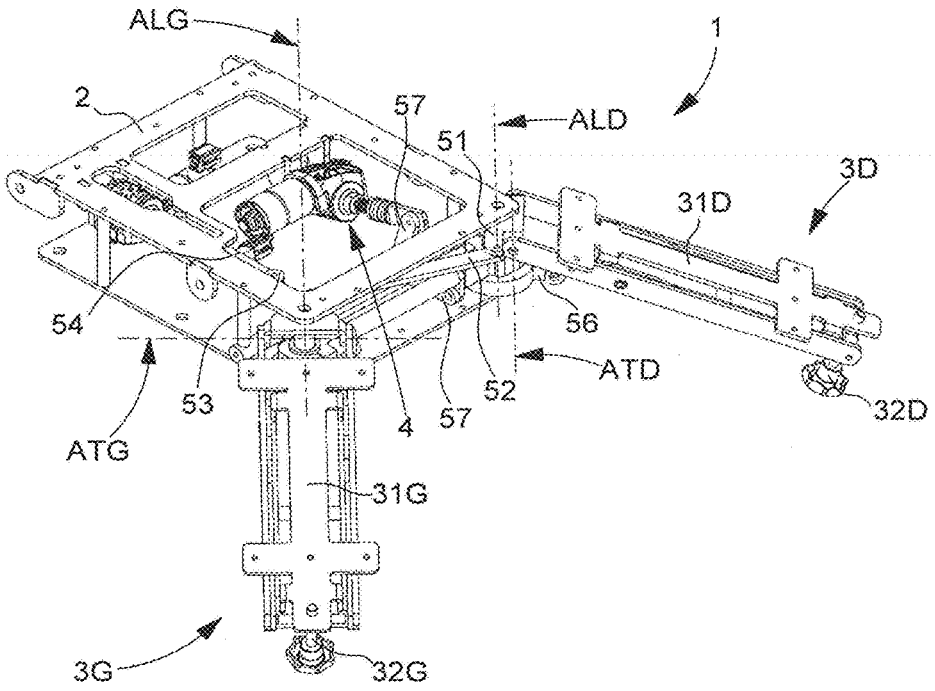
FIG. 1 shows a schematic perspective top view from the front facing the user, seen from the left side, of the central part of an ergonomic workstation according to the invention, wherein a frame incorporating means for controlling, storage, adjustment, powering, linkage, serves as a support for a work platform, on either side of which extend two forearm supports, which are movable with several degrees of freedom and which each form here an angle of around 30° with a horizontal plane, and the projections of which in the same horizontal plane form an angle of 90° with each other.
Figure 2:
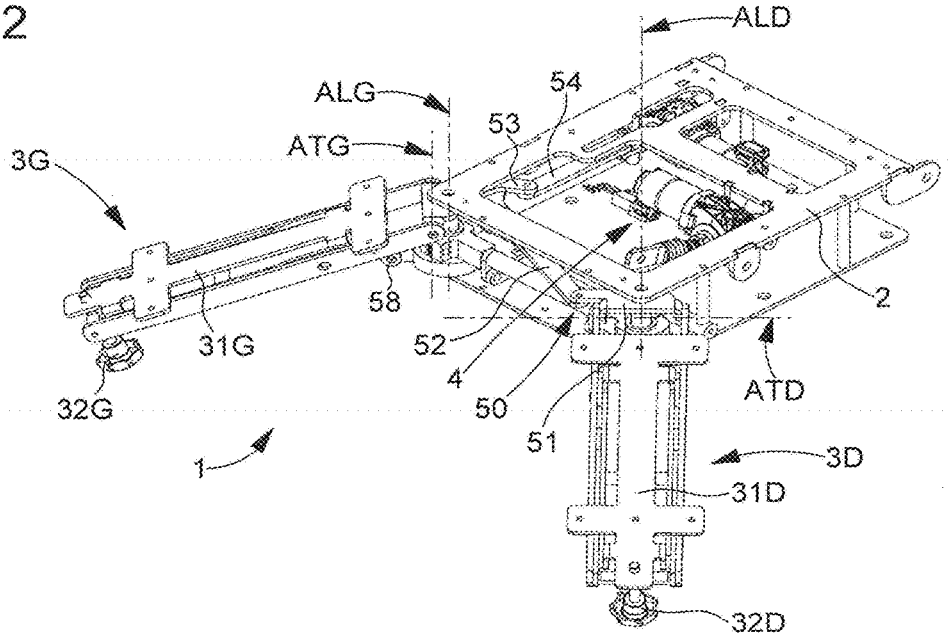
FIG. 2 is the equivalent of FIG. 1 but seen from the right side.
Figure 3:
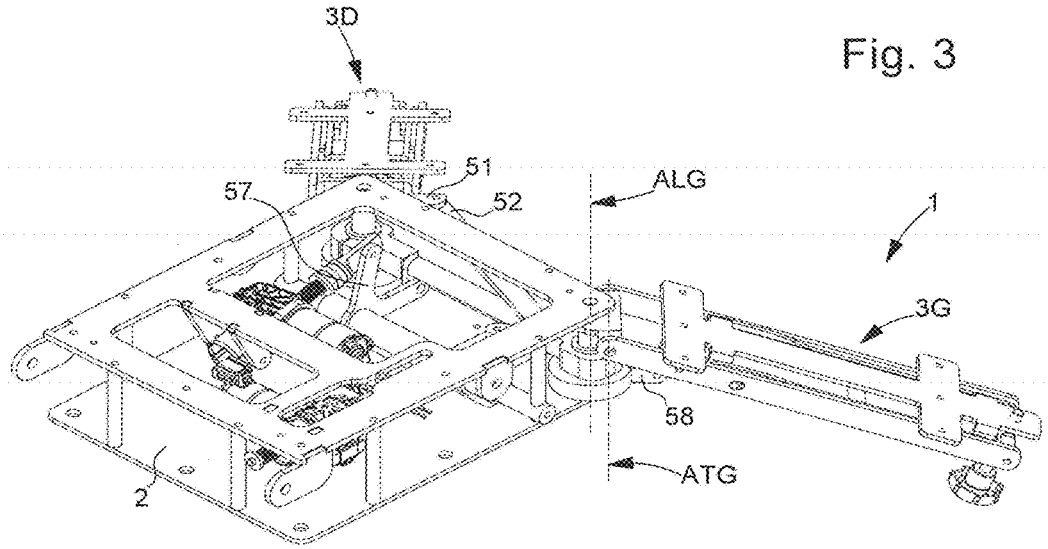
FIG. 3 is a similar view of the same workstation in the same position, seen from behind.
Figure 4:
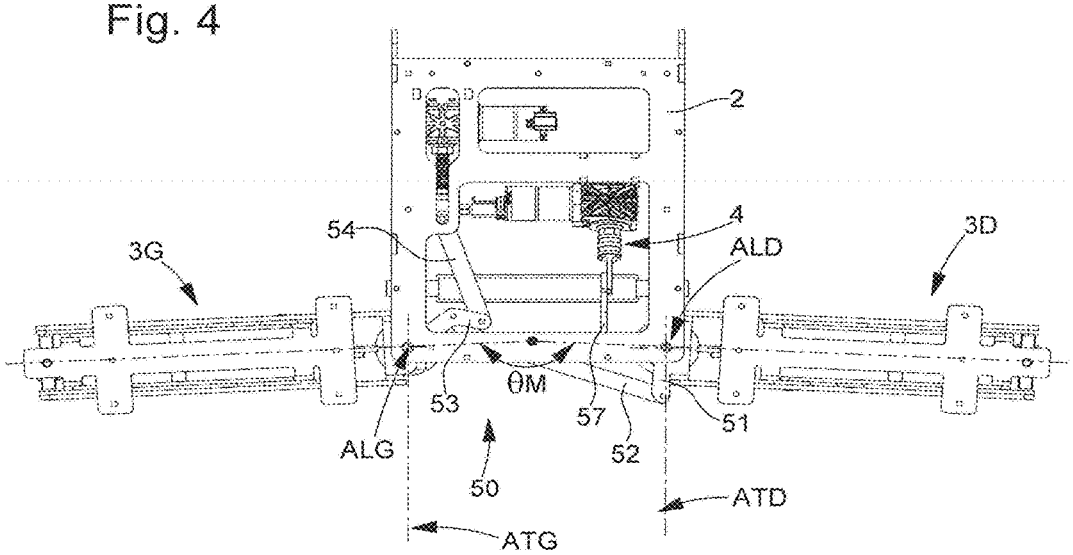
FIG. 4 is a top view of the same workstation in a position where the projections in the same horizontal plane form an angle of 170° with each other.
Figure 5:
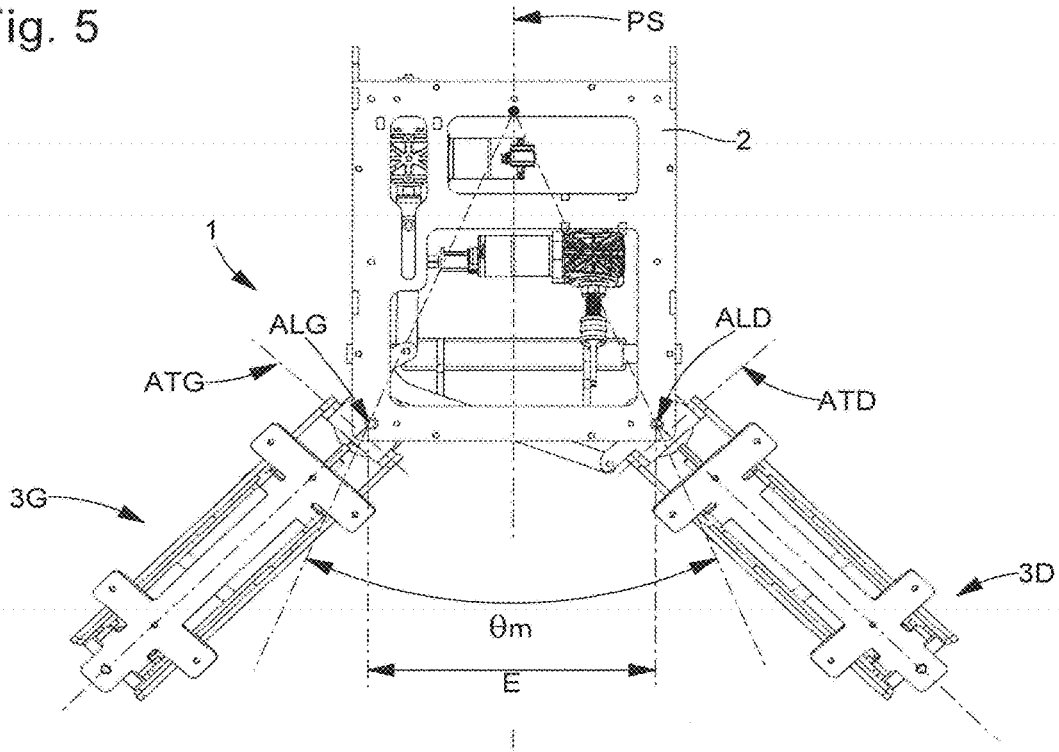
FIG. 5 is a top view of the same workstation in the position of FIGS. 1 to 3, where the projections in the same horizontal plane form an angle of 90° with each other.

The invention concerns an ergonomic watchmaker's workstation 1, on either side of a work platform 2, two forearm supports 3D, 3G, each at least tiltably adjustable in a vertical plane.

This workstation 1 includes control and storage means 40, which are arranged to control motorised adjustment means 4 for moving each forearm support 3D, 3G, in at least one degree of freedom.

Adjustment means 4 may include, in a non-limiting manner, electric motors, air jacks, electric jacks, or other means.

According to the invention, control and storage means 40 are arranged to cause, at predefined moments, or at random moments, depending on how they are programmed, micro-movements of forearm supports 3D, 3G. More specifically, control and storage means 40 are programmable. Preferably, the micro movements are of short duration, less than two seconds, and are of small angular amplitude, less than 2° and/or linear amplitude, less than 5 mm. Preferably, such micro-movements are automatically triggered at least around three times per hour. Of course, it is possible to adjust and/or programme the control means 40 to trigger movements of greater duration and/or amplitude, but the preferred choice of micro movements avoids anomalies in the performance of the task in hand, and prevents operator fatigue, and any associated waste.

Advantageously, workstation 1 also includes a user interface 400 connected to control and storage means 40, for triggering other micro movements and/or for changing the settings.

The user interface 400 includes a screen keyboard, a touch screen or suchlike, adjustment knobs, or foot controls which are appreciated by users because they make it possible to test the changed settings during the performance of a task. The teach-in programming of workstation 1 is thus achieved in a similar manner to the teach-in programming conventionally used in robotics.

Preferably, user interface 400 is arranged to indicate a position error, indicated by sensors, for example a right-left or back-front differential load, or excess pressure on the back of the seat, or on a footrest, or on forearm supports 3D, 3G.

In a conventional manner, user interface 400 displays information from the process planning department and details specific to the manufacturing, assembly, packaging, inspection or similar task.

More specifically, control and storage means 40 are arranged to store first settings relative to a given user, and second settings relative to a given task, and to adapt the adjustments of forearm supports 3D, 3G to the first and second settings.

More specifically, forearm supports 3D, 3G include armrests which contain force sensors connected to control and storage means 40. Control means 40 are preferably programmed to monitor variations in the force exerted by the user on forearm supports 3D, 3G, and to alert the user by a visual and/or sound signal, and/or by triggering a micro movement.

Advantageously, in particular, forearm supports 3D, 3G include armrests which comprise armrest stops, for example in the form of a retaining edge portion, to support the elbow, said armrest stops are adjustable by manual means, or by motorised means which are then advantageously controlled by adjustment means 4. A travel of 20 to 30 mm on either side of a median position is generally sufficient for good user comfort.

More specifically, forearm supports 3D, 3G are each at least tiltably adjustable in a vertical plane by pivoting about a pitch axis ATD, ATG, parallel to work platform 2.

Figure 6:
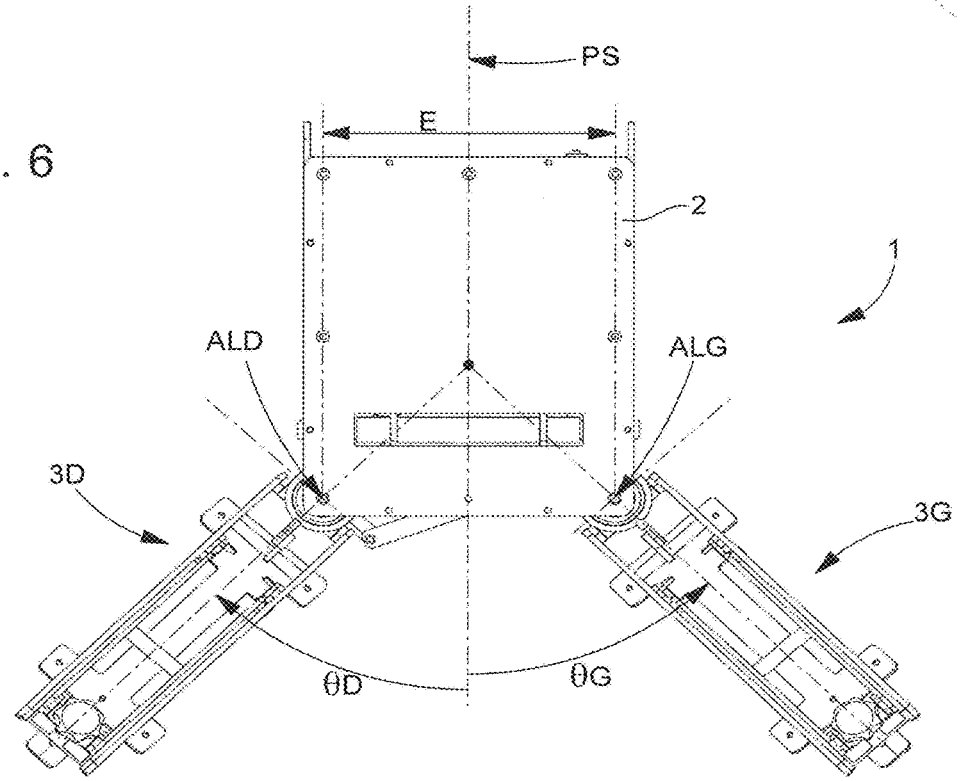
FIG. 6 is a bottom view of the same workstation, in a position where the forearm supports are not symmetrical with respect to the construction plane of the assembly.
Figure 7:
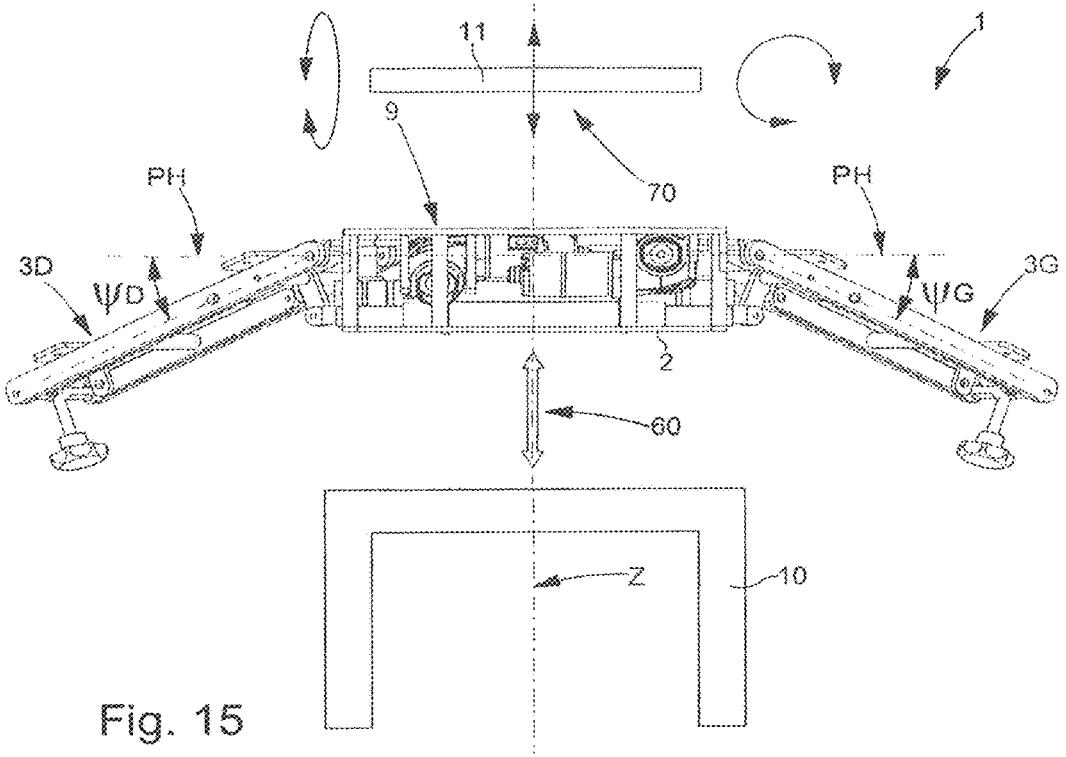
FIG. 7 is a rear view of the same workstation in the position of FIGS. 1 to 3 and 5.

More specifically, forearm supports 3D, 3G can each pivot with respect to work platform 2, by pivoting about a yaw access ALD, ALG, which is perpendicular to work platform 2, with each an opening angle, θD, θG, in projection to this work platform 2, in reference to a symmetry plane PS orthogonal to the upper surface 9 of this work platform 2, as shown in FIG. 6.

In a more complex embodiment, not illustrated by the figures, yaw axes ALD and ALG are separated by a centre-to-centre distance E which is variable and adjustable by manual means or by motorised means, preferably controlled by adjustment means 4.

More specifically, forearm supports 3D, 3G are each swivel adjustable about a roll axis ARD, ARG, parallel to a longitudinal direction in which the forearm support 3D, 3G concerned substantially extends.

In a particular variant, forearm supports 3D, 3G, each include a lower part 31D, 31G, the movement of which is controlled by adjustment means 4, and an upper part 33D, 33G, which carries an armrest and is movable parallel to the respective lower part 31D, 31G, under the action of distance adjustment means 32D, 32G adjustable by manual means, or by motorised means preferably controlled by adjustment means 4. A total travel of 50 to 60 mm is generally sufficient for all user morphologies.

More specifically, workstation 1 includes a single motor, and adjustment means 4 control the elements of a linkage assembly 5 to impart various movements to forearm supports 3D, 3G.

In an advantageous and particularly useful manner during the initial adjustments, control and storage means 40 are arranged to instantaneously return forearm supports 3D, 3G to a symmetrical position relative to a plane of symmetry PS orthogonal to the upper surface 9 of work platform 2, in response to an action of a user on a user interface 400 connected to control and storage means 40. Indeed, for optimum adjustment, the user starts from a perfectly symmetrical position, and performs differential adjustments until he obtains a suitable working position.

Control and storage means 40 may, also, advantageously be arranged to control, directly or via adjustment means 4, additional functions, or elevation means 60 arranged to control a vertical movement of work platform 2 with respect to a frame 10 or operating movements 70 of accessories 11 positioned on an upper surface 9 of work platform 2.

Work platform 2 may also, if necessary, be tilted, and the crossfall thereof facing the user may be adjusted, by around approximately 2° with respect to a horizontal plane, beyond these values, it is better to position a multi axis table top, notably with 5 axes, on platform 2.

Figure 15:
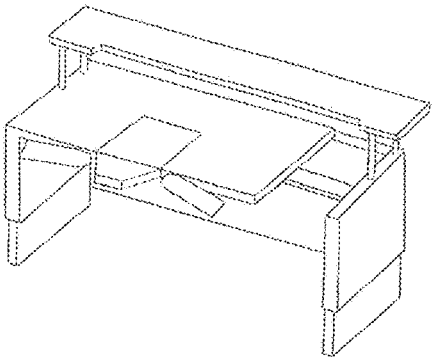
FIGS. 15 and 16 show perspective and top views of a workstation according to the invention, whose supporting structure is a piece of furniture with height adjustable side bars.
Figure 16:
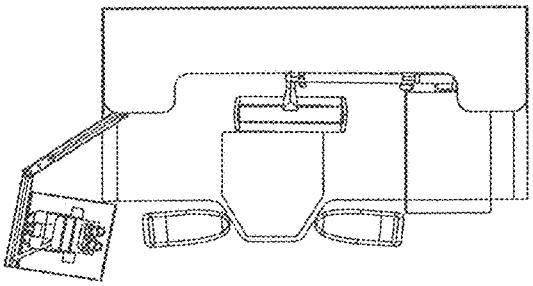
Figure 8:
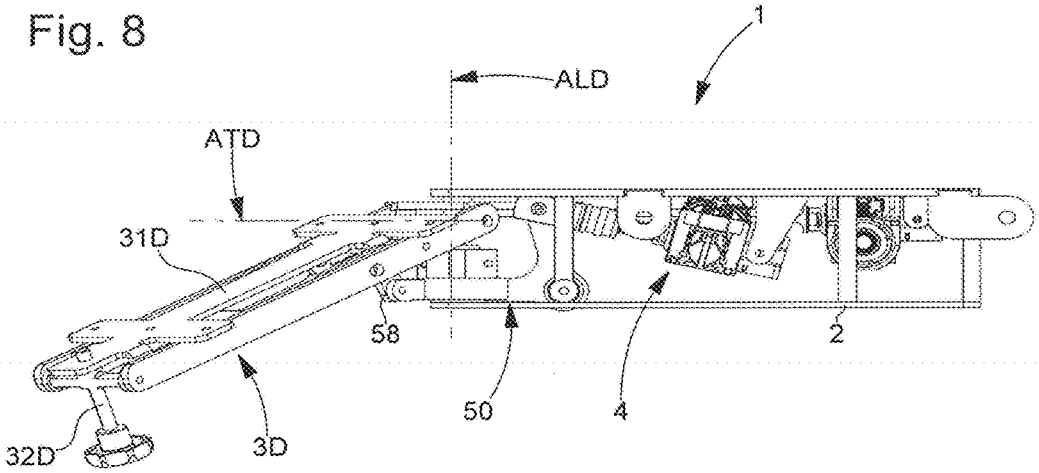
FIG. 8 is a view from the right side.
Figure 9:
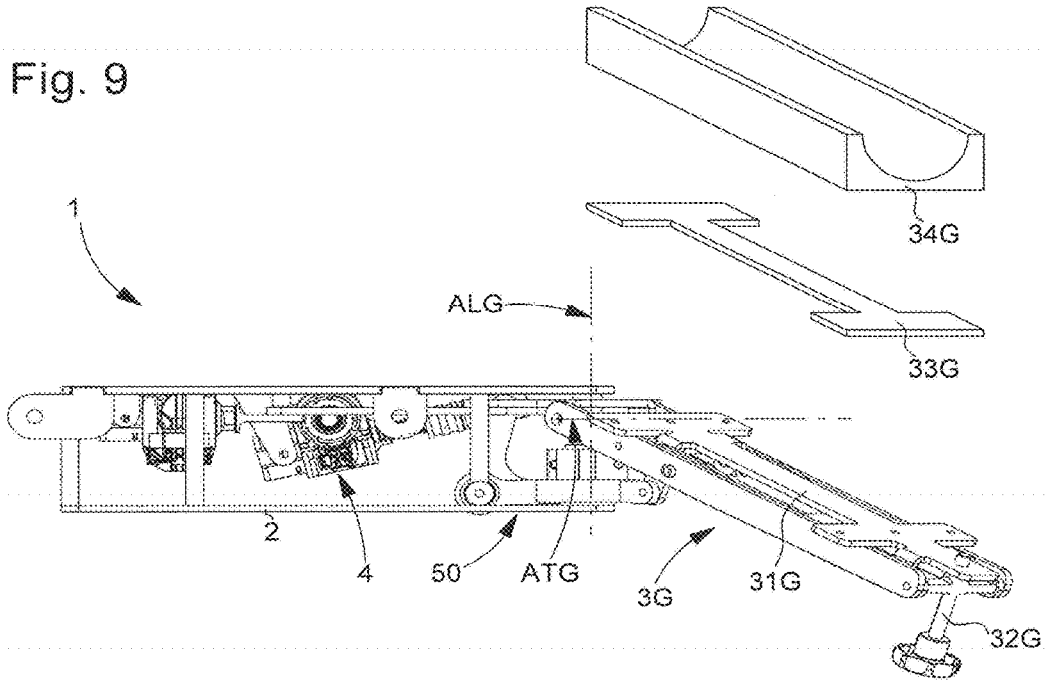
FIG. 9 is a view from the left side.
Figure 10:
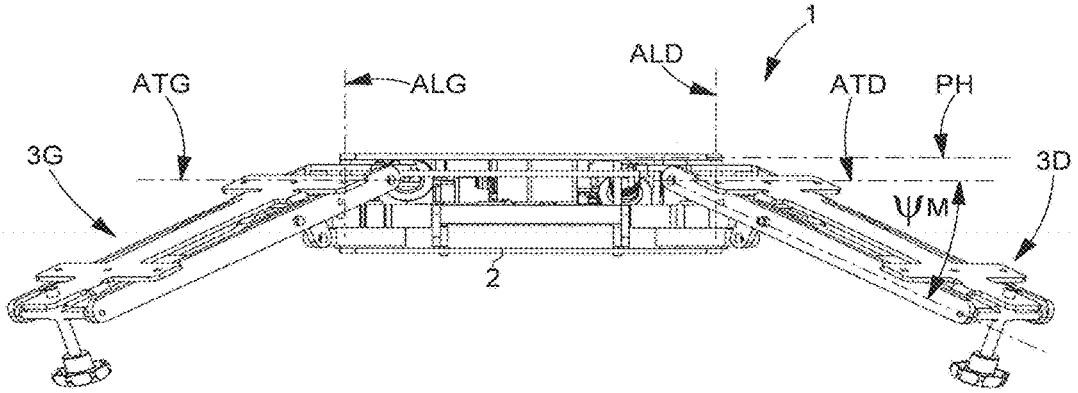
FIG. 10 is a front view of the same assembly in the same position.
Figure 11:
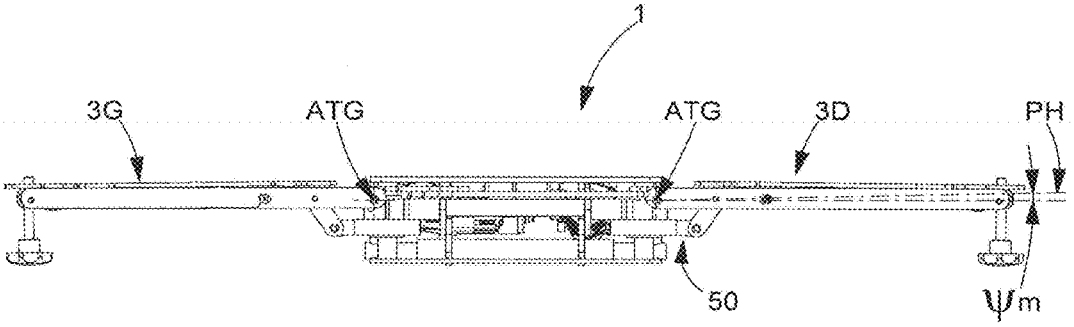
FIG. 11 is a front view with the arm holder supports in a horizontal plane.
Figure 12:
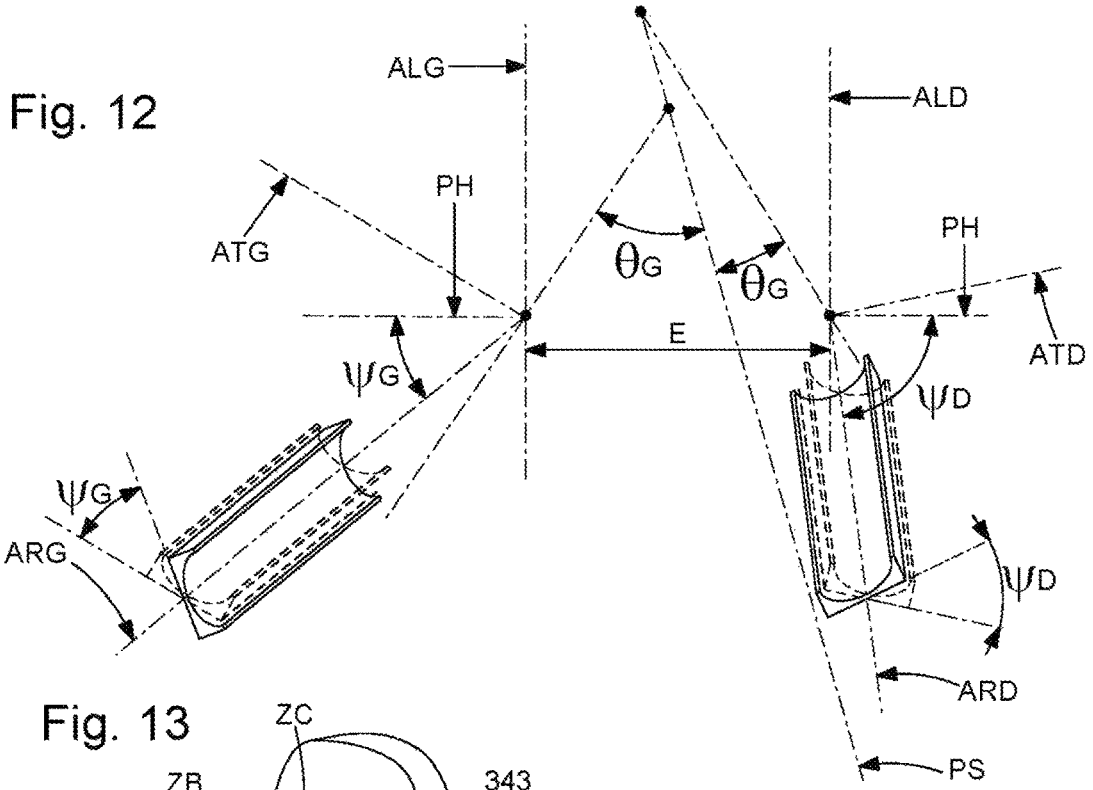
FIG. 12 illustrates the angles of yaw, pitch and roll of the arm holder supports.
Figure 13:
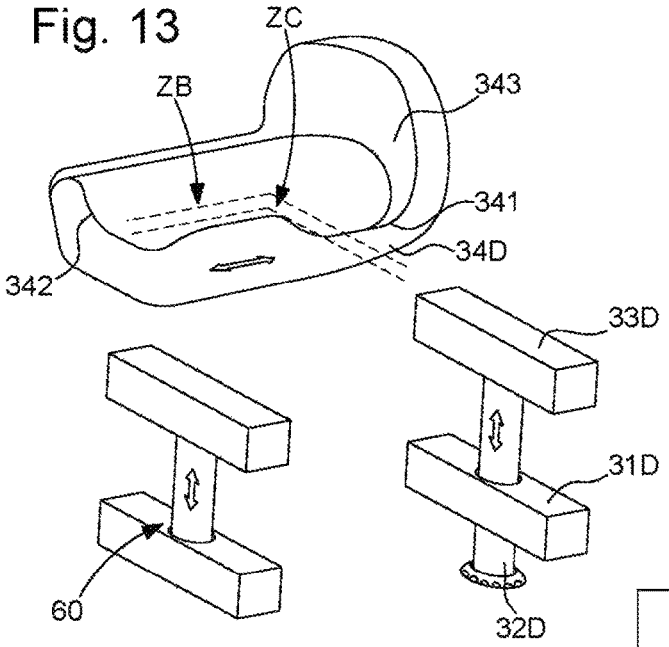
FIG. 13 illustrates, as in FIG. 9, one of the arm holder supports, which is formed of two, upper and lower parts adjustable in relation to each other, with the upper part receiving a padded armrest.
Figure 14:
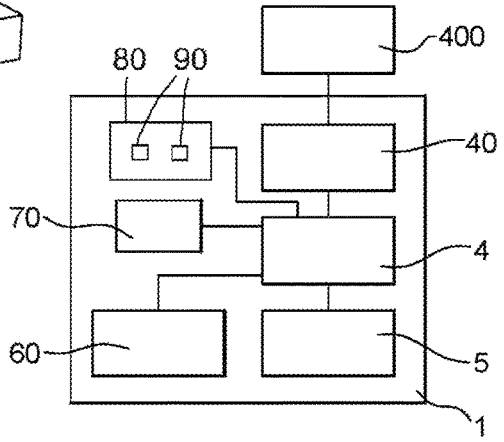
FIG. 14 is a block diagram illustrating the cooperation of the various means that may be comprised in the workstation of the invention.

FIGS. 15 and 16 show a workstation 1, whose supporting structure is a piece of furniture with height adjustable side bars.

In a still more complete variant, the workstation includes a chair 80 for the user, provided with force sensors 90 connected to control and storage means 40. In particular, weight sensors allow control means 40 to apply shorter position change periods for the heaviest people.

More specifically, control and storage means 40 are then arranged to control adjustment means 4 to adjust the distance between the chair 80 and work platform 2. Naturally, torque or force sensors 90 are arranged to stop any relative motion if a limb is caught or crushed.

Naturally, such a chair 80 may also be equipped, like forearm supports 3D, 3G, to ensure lumbar comfort, proper neck support to protect the cervical vertebrae, a tilting headrest, or support for the armpits or suchlike.

The invention lends itself well to modular fabrication to improve existing workstations. An elementary module may consist of a single forearm support 3D or 3G, equipped to allow movements in several degrees of freedom, and pre-prepared for motorisation by being fitted with a pre-assembled linkage assembly. The same module may, also, include an actuation motor, and connections to a user interface 400, control and storage means 40, and adjustment means 4. A double module consists of a frame equipped with two forearm supports 3D and 3G, in a mechanical version pre-prepared for motorisation, or already motorised.

What is claimed is:

1. An ergonomic watchmaker's workstation comprising:

two forearm supports each at least tiltably adjustable in a vertical plane;

a controller including a memory and arranged to control a motorized adjuster in order to move each said forearm support in at least one degree of freedom, said controller being programmable in order to trigger, at predefined or random moments, micro movements of said forearm supports of short duration of less than two seconds, and of small angular amplitude of less than 2° and/or of linear amplitude of less than 5 mm; and a user interface connected to said controller, to trigger other micro movements, and/or to modify settings.

2. The workstation according to claim 1, wherein said controller is arranged to store first settings relative to a given user, and second settings relative to a given task, and to adapt adjustments of said forearm supports to said first and second settings.

3. The workstation according to claim 1, wherein said forearm supports include armrests which contain force sensors connected to said controller.

4. The workstation according to claim 1, wherein said forearm supports include armrests that comprise armrest stops to support an elbow, said armrest stops are adjustable manually or by a device including a motor controlled by said adjuster.

5. The workstation according to claim 1, wherein said forearm supports are each at least tiltably adjustable in a vertical plane by pivoting about a pitch axis parallel to a work platform.

6. The workstation according to claim 1, wherein said forearm supports can each at least pivot with respect to a work platform, by pivoting about a yaw axis perpendicular to said work platform, with each an opening angle in projection to said work platform, in reference to a symmetry plane orthogonal to an upper surface of said work platform.

7. The workstation according to claim 6, wherein said yaw axes are separated by a center-to-center distance which is variable and adjustable manually or by a device including a motor, which is then controlled by said adjuster.

8. The workstation according to claim 1, wherein said forearm supports are each swivel adjustable about a roll axis parallel to a longitudinal direction in which said forearm support concerned substantially extends.

9. The workstation according to claim 1, wherein said forearm supports each include a lower part, movement of which is controlled by said adjuster, and an upper part, which carries an armrest and is movable parallel to said respective lower part, under action of a distance adjuster adjustable manually or by a device including a motor which is then controlled by said motorized adjuster.

10. The workstation according to claim 1, wherein said workstation includes a single motor, and wherein said adjuster controls elements of a linkage assembly to impart different movements to said forearm supports.

11. The workstation according to claim 1, wherein said controller is arranged to instantaneously return said forearm supports to a symmetrical position relative to a plane of symmetry orthogonal to an upper surface of said work platform, in response to an action of a user on the user interface connected to said controller.

12. The workstation according to claim 1, wherein said controller is arranged to control additional functions, to control a vertical movement of said work platform with respect to a frame or operating movements of accessories positioned on an upper surface of said work platform.

13. The workstation according to claim 1, wherein said workstation includes a supporting structure which is a piece of furniture with height adjustable side bars.

14. The workstation according to claim 1, wherein said workstation includes a chair provided with force sensors connected to said controller.

15. The workstation according to claim 14, wherein controller is arranged to control said adjuster to adjust a distance between said chair and said work platform.

* * * * *